United States Patent [19]

Kawahara et al.

[11] 4,367,958

[45] Jan. 11, 1983

[54] CORRECTION SIGNAL GENERATING SYSTEM FOR AN ELECTRONIC TIMEPIECE

[75] Inventors: Hisashi Kawahara; Tadashi Hanaoka; Masamichi Yamauchi, all of Tanashi, Japan

[73] Assignee: Citizen Watch Company Limited, Tokyo, Japan

[21] Appl. No.: 169,066

[22] Filed: Jul. 15, 1980

[30] Foreign Application Priority Data

Jul. 17, 1979 [JP] Japan ..... 54-90808
Aug. 31, 1979 [JP] Japan ..... 54-111295

[51] Int. Cl.[3] ..... G04C 9/00
[52] U.S. Cl. ..... 368/188; 368/190
[58] Field of Search ..... 368/187, 188, 189, 190, 368/185

[56] References Cited

U.S. PATENT DOCUMENTS 4,196,584 4/1980 Oda ..... 368/187
4,246,650 1/1981 Moritani et al. ..... 368/188 X
4,257,114 3/1981 Sekiya et al. ..... 368/188 X
4,306,302 12/1981 Sekiya et al. ..... 368/187

*Primary Examiner*—B. A. Reynolds
*Assistant Examiner*—Philip H. Leung
*Attorney, Agent, or Firm*—Jordan and Hamburg

[57] ABSTRACT

An electronic timepiece is provided with a correction signal generating system for producing correction pulses to modify current time or other data. The system includes a rotary switch, coupled to a timepiece crown to be rotated thereby and having a plurality of fixed and movable contacts, with the number of movable contacts being less than the number of fixed contacts, and circuit means for producing a train of correction pulses from either of two output terminals in accordance with the direction of rotation of the timepiece crown. Correction pulses from one of these output terminals serves to increment the quantity being corrected, while correction pulses from the other output terminal serve to decrement that quantity. Gearing may be provided between the crown and the switch rotor, to increase the maximum rate of generation of correction pulses.

7 Claims, 5 Drawing Figures

| Fig. 4A | Fig. 4B |
|---|---|

CORRECTION SIGNAL GENERATING SYSTEM FOR AN ELECTRONIC TIMEPIECE

BACKGROUND OF THE INVENTION

The present invention is directed toward a system for generating correction pulses in an electronic timepiece, and particularly toward a system for generating correction pulses in an electronic timepiece having a digital display.

At the present time, electronic timepieces having digital displays have become extremely popular. In such timepieces, a crystal oscillator circuit provides a standard timebase signal, while a digital display of time or other information is provided by means of a liquid crystal display. In order to correct or modify a quantity which is computed by or stored in such a timepiece (such as current time or alarm time information) it is necessary usually to alter a number of digits. Various means of correction of such information have been proposed in the past. However the method which has most widely been adopted is that called the "select-and-set" system. In this system, two pushbuttons are employed, one being actuated to select the digit to be corrected, and the other being actuated to correct the selected digit. Such a system has various disadvantages. One of these is that the method is very different from the conventional method of correcting a timepiece, i.e. by rotating the timepiece crown, which is still the most familiar method for many people. Another is that it is generally necessary to actuate the setting pushbutton (i.e. the second one referred to above) a number of times in succession, in order to correct a particular digit. Yet another disadvantage is that such correction is generally unidirectional, i.e. correction is performed only by incrementing the digit being corrected, although various methods have been proposed for providing bidirectional correction, of varying degrees of complexity.

For the above reasons, a conventional method of correction, such as the set-and-select method described above tends to discourage prospective purchasers from buying an electronic digital timepiece, due to the apparent complicated operations necessary with such a method. It may be difficult for some prospective buyers to comprehend the correction method as explained in the instruction manual, particularly in the case of persons buying a timepiece for the first time. A correction or setting method which is relatively complicated and time consuming is especially undesirable in the case of setting alarm time information, in a timepiece having an alarm function, since the setting of such information must be performed relatively frequently.

It is therefore desirable to provide a system in an electronic timepiece having a digital display whereby correction of current time or other information can be carried out in a simple, uncomplicated manner, and that bidirectional correction should be possible without increasing the complexity of the correction procedure or increasing the number of operating members which must be actuated to perform correction. These requirements are met by the correction signal generating system of the present invention, which also provides the advantage that correction is performed by rotating a timepiece crown, a method which is familiar to very many people.

SUMMARY OF THE INVENTION

The present invention comprises a correction signal generating system for an electronic timepiece, whereby a train of correction pulses for incrementing a quantity to be corrected or a train of correction pulses for decrementing that quantity are selectively produced in accordance with the direction of rotation of a timepiece crown. The crown is coupled to a switch having a plurality of fixed and a plurality of movable contacts, with the number of movable contacts being less than the number of fixed contacts, and may be coupled to the switch through a set of gears, in order to increase the maximum rate of generation of correction pulses. Logic circuitry coupled to receive switching pulses from the fixed contacts serves to discriminate the direction of rotation of the timepiece crown, and to thereby produce correction pulses for either incrementing or decrementing the desired quantity. For example if the quantity to be corrected is stored in a bidirectional, i.e. "up/down" counter register, then the correction pulse train can be applied to the "count up" terminal of that counter to increment the quantity being corrected, and can be applied to the "count down" terminal of the counter to decrement the quantity being corrected.

DESCRIPTION OF THE PREFERRED EMBODIMENT

Figure 1:
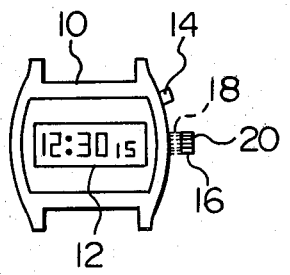
FIG. 1 is a plan view of an embodiment of an electronic wristwatch which is equipped with a correction signal generating system according to the present invention.

Referring first to FIG. 1, a plan view is given therein illustrating the external appearance of an electronic timepiece equipped with a correction signal generating system according to the present invention. Reference numeral 12 denotes a liquid crystal digital display. Numeral 14 denotes a function selection pushbutton. By successively actuating pushbutton 14, current time, calendar, or alarm time information can be selected to be displayed by display 12. Numeral 16 denotes a timepiece crown, which is normally left in a position denoted by numeral 18, during usual operation of the timepiece, but can be pulled out to a second position 20, for the purpose of generating correction signal pulses. When crown 16 is in position 18, i.e. pushed inward, then even if crown 16 is rotated, no effect upon the operation of the timepiece will be produced. However, if crown 16 is pulled out to position 20, then rotation of crown 16 causes correction signal pulses to be produced, as described hereinafter, whereby the quantity currently being displayed by digital display 12 (i.e. the quantity which has been previously selected by means of function selection switch 14) is modified. In this embodiment, rotation of crown 16 in the clockwise direction causes the selected information to be incremented, while rotation of crown 16 in the counterclockwise direction results in the selected information being decremented.

Figure 2:
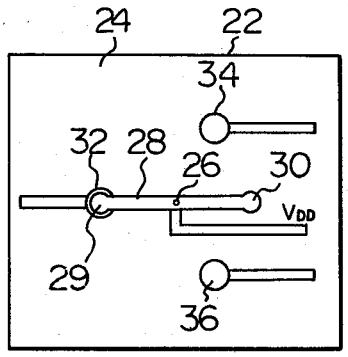
FIG. 2 is a simplified plan view illustrating the general arrangement of components in an embodiment of a correction switch for a correction signal generating system according to the present invention.

FIG. 2 is a simplified drawing to illustrate the main components of a correction switch for a correction signal generating system according to the present invention. This is a rotary switch, based on a switch substrate 24 and actuated by means of a rotatable shaft 26. A switch rotor 28 is provided with two movable contacts 29 and 30 and is fixedly mounted on shaft 26 to be rotated thereby. Three fixed contacts 32, 34 and 36 are fixedly mounted on the upper surface of switch substrate 24, and are arrayed concentrically about the axis of rotatable shaft 26 at a pitch of 120°. A supply voltage Vdd is connected to rotatable shaft 26, and hence to movable contacts 29 and 30. Fixed contacts 32, 34 and 36 are each connected to input terminals of a correction signal generating circuit, described hereinafter.

The operation of the correction switch of FIG. 2 will now be described. If the timepiece crown is rotated in the clockwise direction, thereby rotating the switch shaft 26, contact between movable contact 29 and fixed contact 32 will be broken. There is now no contact between either of movable contacts 29 and 30 and the fixed contacts 32, 34 and 36. As the crown is rotated further, movable contact 30 comes into contact with the fixed contact 36. This contact is then broken, and as rotation is continued, contact is established between movable contact 29 and fixed contact 34. In this manner, as the switch shaft 26 is rotated, contact is established in a cyclic, repetitive manner between movable contact 29 and fixed contact 32, then between movable contact 30 and fixed contact 36, between movable contact 29 and fixed contact 34, and so on. Thus, as the timepiece crown is rotated in the clockwise direction, the movable contacts 29 and 30 of switch rotor 28 are successively and repetitively connected to the fixed contacts 32, 34 and 36, in that order. If however the crown is rotated in the counterclockwise direction, then the movable contacts 29 and 30 will be connected to the fixed contacts in the order 32, 36, 34.

It is a precondition for a correction switch of a correction signal generating system according to the present invention that the number of movable contact and the number of fixed contacts of the switch should be such as not to have a common divisor. In other words, if the number of fixed contacts is n, the number of movable contacts should be (n-1). In the present embodiment, n has a value of 3, so that there are three fixed contacts and two movable contacts. Such an arrangement may be preferable in the case of a wristwatch, in which the space available for providing a correction switch is limited, however other values of n are also possible.

Figure 3:
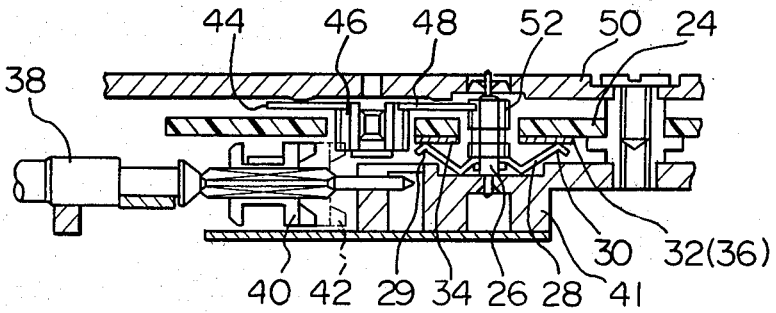
FIG. 3 is a cross-sectional view of a correction switch for a correction signal generating system according to the present invention, and an arrangement of gears for coupling the correction switch to a timepiece crown.

Referring now to FIG. 3, a cross-sectional view in elevation is shown of a correction switch mechanism for the present embodiment. Numeral 38 denotes a shaft which is mechanically coupled to the winding stem of the timepiece, and hence to crown 16, such as to be rotated by rotation of crown 16 and to be moved in an inward direction (i.e. rightward, in FIG. 3) when crown 16 is pulled out to position 20 shown in FIG. 1, and to be moved in an outward direction (i.e. leftward, in FIG. 3) when crown 16 is pushed inward to position 18 of FIG. 1. A clutch wheel 40 is fixedly mounted on shaft 38, to be rotated by rotation of crown 16. A correction transmission wheel 44, consisting of a correction transmitting pinion 46 and a correction transmitting gear 48 is rotatably mounted on a bridge 50. Clutch wheel 40 is shown in FIG. 3 in the position corresponding to crown 16 being set to its inward position, i.e. position 18 in FIG. 1. In this position, clutch wheel 40 is disengaged from the correction transmission wheel 44, so that rotation of crown 16 in this position does not result in rotation of correction transmission wheel 44. When crown 16 is pulled out to position 20, then clutch wheel 40 is moved to the position indicated by a phantom dotted line outline, and indicated by numeral 42. In this position, clutch wheel 40 meshes with correction transmission wheel 44, so that rotation of crown 16 results in rotation of correction transmission wheel 44.

Correction transmission wheel 44 meshes with a correction switch wheel 52, and the gear ratios of correction transmission wheel 44 and correction switch wheel 52 are selected such that rotation of the timepiece crown 16, transmitted through correction transmission wheel 44, causes the correction switch wheel to be rotated at a considerably higher speed than crown 16. A switch rotor 28 is fixedly mounted on the shaft 26 of correction switch wheel 52, and is provided with movable contacts 29 and 30.

Three fixed contacts, 32, 34 and 36, each consisting of electrically conductive patterns, are formed on a switch substrate 24. The relationships between the fixed contacts 32, 34 and 36 and the movable contacts 29 and 30 are as indicated in FIG. 2. The movable contacts 29 and 30 can simply comprise portions of the switch rotor 28, which is formed of a resilient electrically conductive material. The lower end of shaft 26 is rotatably mounted in a base plate 41, such that electrical contact is provided between the movable contacts 29 and 30 and base plate 41, Thus, when the timepiece crown is rotated, with the crown pulled to its outward position so that clutch wheel 40 meshes with correction transmission wheel 44, electrical contact is repetitively and successively established between the base plate 41 and fixed contacts 32, 34 and 36. Because of the speed multiplying effect of the gears provided between crown 16 and shaft 26 of the correction switch, the rate at which contact is made and broken between the base plate 41 and fixed contacts 32, 34 and 36 can be high enough to generate correction signal pulses at a suitable rate, as will be described hereinafter.

Figures 4, 4A:
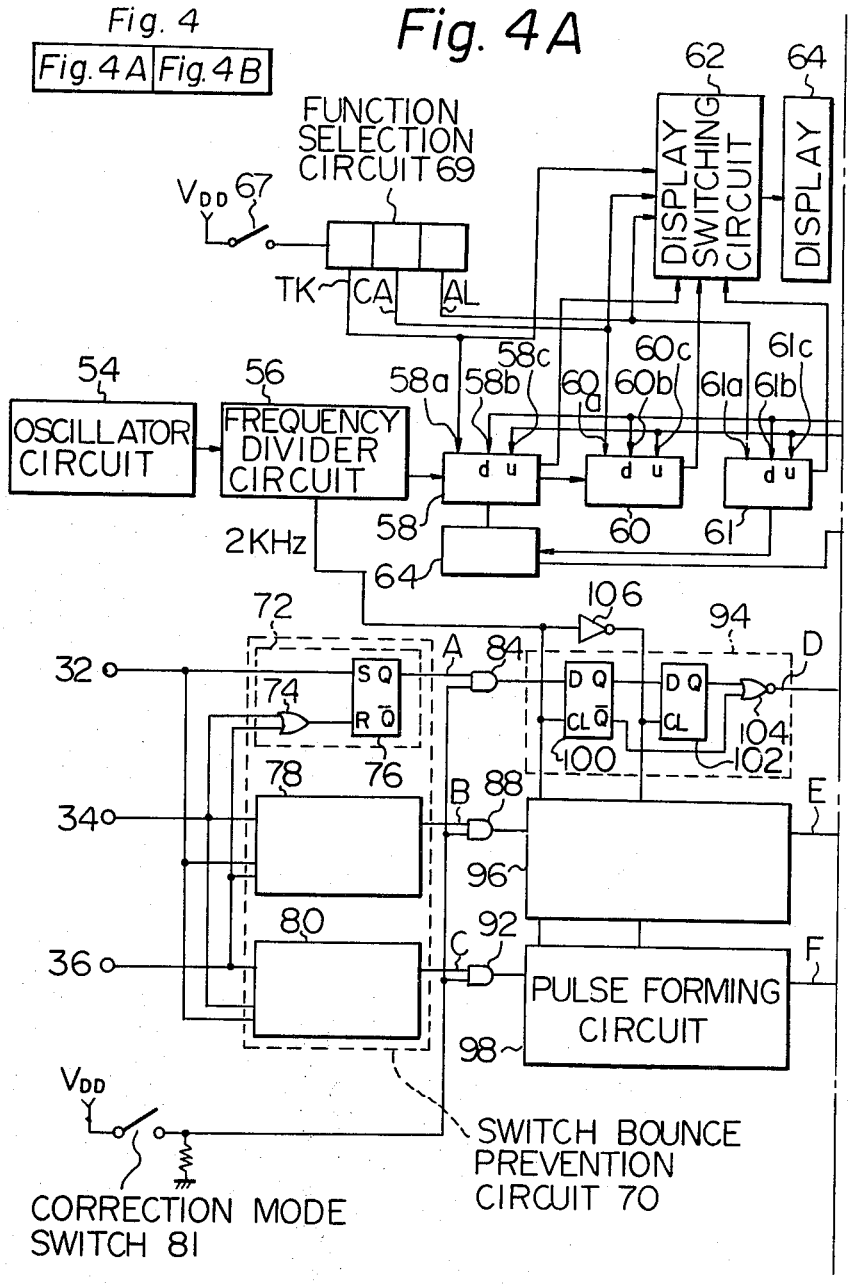
FIG. 4 is a block wiring diagram of an electronic timepiece equipped with a correction signal generating system according to the present invention.
Figure 4B:
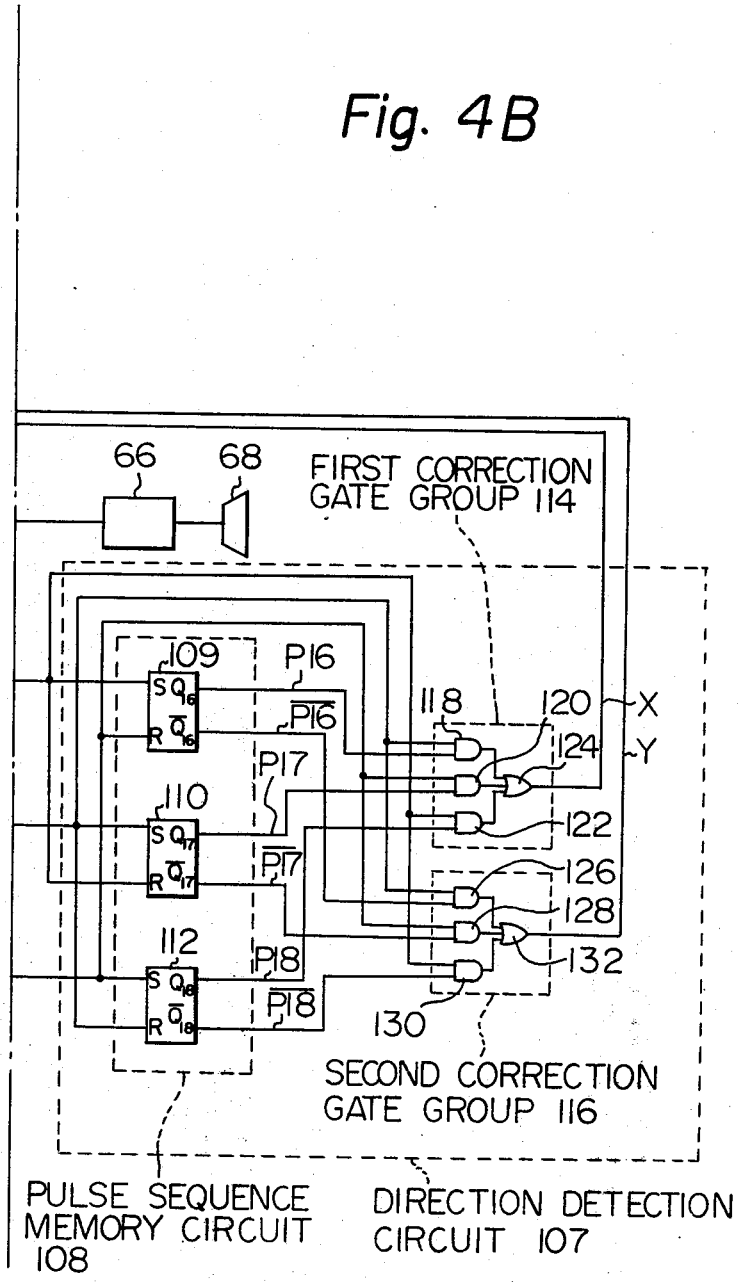
Figure 5:
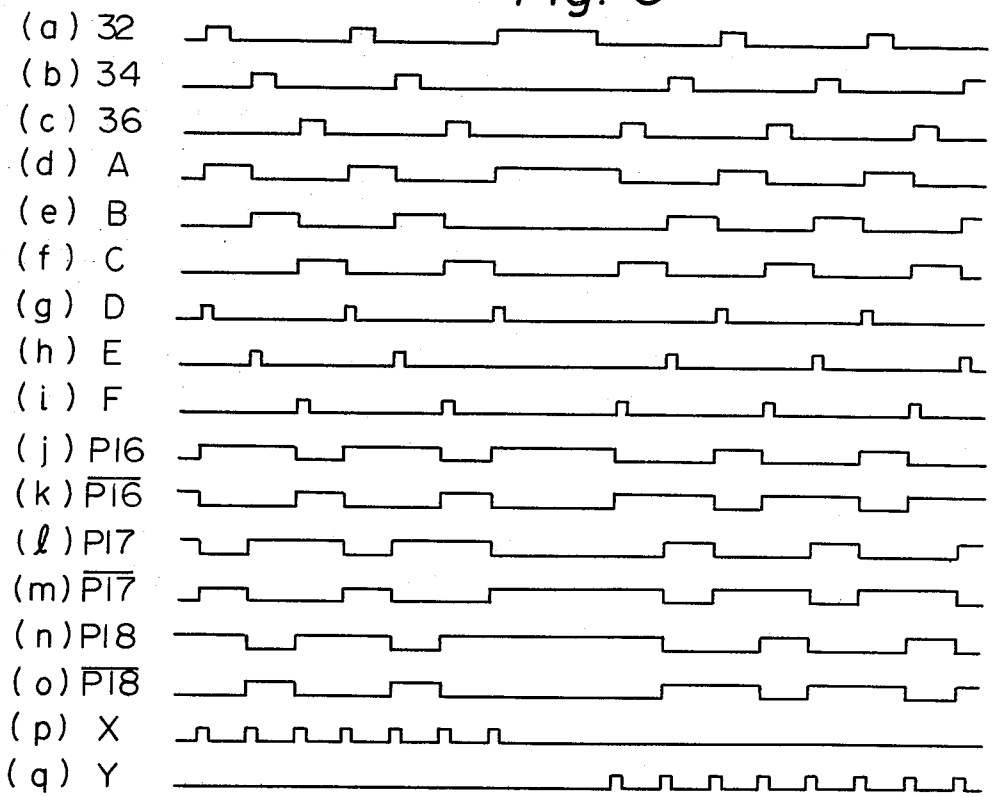
FIG. 5 is a waveform diagram illustrating various signals produced in the circuit of FIG. 4.

Referring now to FIG. 4, a block circuit diagram is shown of an electronic timepiece which incorporates a correction signal generating system according to the present invention, and a correction switch such as that illustrated in FIG. 2 and FIG. 3. Waveforms of various signals produced in the circuit of FIG. 4 are shown in FIG. 5 waveform diagrams. In FIG. 4, reference numeral 54 denotes a source of a standard timebase signal of relatively high frequency, such as a crystal oscillator circuit. The timebase signal is applied to a frequency divider circuit 56, which frequency divides this signal to produce a time unit signal having a frequency of 1 Hz and a clock signal having a frequency of 2 KHz.

A timekeeping counter circuit 58 receives the time unit signal from frequency divider circuit 56, to compute the hours, minutes and seconds of current time information. Timekeeping counter circuit 58 is a bidirectional counter (i.e. an UP/DOWN) type of counter circuit, and in addition to receiving the time unit signal from frequency divider 56, timekeeping counter circuit 58 is also coupled to receive correction signal pulses on terminals 58*b* and 58*c*. When a selection signal is applied to a control terminal 58*a*, timekeeping counter circuit 58 is enabled to count up in response to correction pulses applied to terminal 58*c*, or to count down, in response to correction pulses applied to terminal 58*b*.

A carry signal produced by timekeeping counter circuit 58 is applied to a calendar counter circuit 60, which thereby computes year, month and date information. Calendar counter circuit 60 is also a bidirectional counter, and is provided with a control terminal 60*a*, a count up terminal 60*c* and a count down terminal 60*b*, having identical functions to those described for terminals 58*a*, 58*b* and 58*c* of timekeeping counter circuit 58.

Numeral 61 denotes an alarm memory circuit, for storing alarm time information consisting of minutes and hours information. Alarm memory circuit 61 also consists of a bidirectional counter, having a control terminal 61*a* and a count up terminal 61*c* and a count down terminal 61*b*.

An alarm coincidence circuit 64 is coupled to receive the alarm time information stored in alarm memory circuit 61 and the current time information provided by timekeeping circuit 58, and serves to compare the current time and alarm time information and produce an output signal to indicate when coincidence occurs between them. This alarm coincidence indicating output signal is applied to an acoustic drive circuit 66, the output from which is applied to an acoustic transducer 68, for thereby generating an audible alarm signal from the timepiece when alarm coincidence is detected.

Reference numeral 67 denotes a function selection switch, which is actuated by an external operating member such as function selection pushbutton shown in FIG. 1. Signals produced from function selection switch 67 are applied to a function selection circuit 69. Function selection circuit 69 is composed of three shift register stages connected in series, and produces output signals designated as TK, CA and AL, successively, in response to successive actuations of function selection switch 67.

Reference numeral 62 denotes a display switching circuit. Display switching circuit 62 is responsive to output signals TK, CA and AL from function selection circuit 69 for selectively transferring current time information from timekeeping counter circuit 58, calendar counter circuit 60 or alarm memory circuit 61 respectively to be displayed by a display device 64, in digital form. Signal TK from function selection circuit 69 is also applied to control terminal 58*a* of timekeeping counter circuit 58 to enable incrementing or decrementing the contents of counter circuit 58 in response to correction signal pulses (generated as described hereinafter) applied to terminals 58*a* and 58*c*. Thus, while signal TK is selecting the current time information from timekeeping counter 58 to be displayed by display device 64, signal TK simultaneously enables the current time information contained in timekeeping counter 58 to be corrected. Similarly, while signal CA is being produced, thereby selecting the calendar information to be displayed by display device 64, signal CA simultaneously enables the calendar information contained in calendar counter circuit 60 to be corrected. Further, when signal AL is being produced, thereby selecting alarm time information to be displayed by display device 64, signal AL simultaneously enables the alarm time information contained in alarm memory circuit 61 to be modified, if desired.

The method of generating correction signal pulses will now be described. Numeral 70 denotes a switch bounce prevention circuit, which serves to prevent any spurious pulses generated by the correction switch from affecting the process of generating correction pulses. Circuit 70 is coupled to stationary contacts 32, 34 and 36 of the correction switch, which are successively connected to a high logic level potential (referred to hereinafter as the H level) as they are successively contacted by the movable contacts 29 and 30. Circuit 70 is composed of three circuit blocks, denoted by numerals 72, 78 and 80 respectively. Circuit block 72 is composed of a set/reset latch circuit 76 and an OR gate 74. Fixed correction switch contact 32 is coupled to the set terminal of latch circuit 76, while fixed contacts 34 and 36 are connected to the inputs of OR gate 74. The output of OR gate 74 is connected to the reset terminal of latch circuit 76. Each of the circuit blocks 78 and 80 is of identical construction to that of block 72. In circuit block 78, a latch circuit has fixed contact 34 connected to its set terminal, and an OR gate has its input terminals connected to fixed contacts 32 and 36. Similarly, in circuit block 80, a latch circuit has fixed contact 36 connected to its set terminal, and an OR gate has fixed contacts 32 and 34 connected to its inputs. As in circuit block 72, the output of the OR gate in each of circuit blocks 78 and 80 is connected to the reset terminal of the set/reset latch circuit in that circuit block. Output signals from circuit blocks 72, 78 and 80 of switch bounce prevention circuit 70 are denoted by the letters A, B and C respectively.

The operation of circuit 70 will now be described. We shall first assume that fixed contact 32 is initially connected, through one of the movable contacts 29, to a source of a high logic level potential (referred to hereinafter as the H level potential) which is coupled to base plate 41 shown in FIG. 3. In this condition, latch circuit 76 of circuit block 72 will be in the set state, so that the output signal A from latch circuit 76 is at the H level potential. At this time also, the latch circuits of circuit blocks 78 and 80 are in the reset state due to application of the H level signal from fixed contact 32, so that the outputs B and C from circuit blocks 78 and 80 are at the low logic level potential (referred to hereinafter as the L level potential). If we assume that the correction switch is rotated in the clockwise direction, then the connection between the H level potential and fixed contact 32 will be broken, so that all of the fixed contacts 32, 34 and 36 go to the L level. However the outputs A, B and C from circuit 70 remain at the H, L and L levels respectively. Next, fixed contact 34 is connected to the H level potential, so that signal B from circuit block 78 goes to the H level potential, while signals A and C are both reset to the L level potential. The contact between fixed contact 34 and the H level potential is then broken, leaving the potential levels of outputs A, B and C unchanged. As rotation of the correction switch is continued, fixed contact 36 is next connected to the H level potential, while contacts 32 and 34 remain at the L level potential. As a result, output B of circuit block 80 goes to the H level potential, while outputs A and C are reset to the L level potential. Continued rotation of the crown 16 results in the sequence of events described above being repeated continuously, i.e. first output A, then output B, then output C, and so on, goes to the H level potential while the other outputs are reset to the L level potential. It will be noted that if any switch bounce occurs, i.e. if for example movable contact 29 should rapidly make-and-break contact several times when it reaches fixed contact 32, this will have no effect upon the generation of signal A from latch circuit 76, since the first time contact is made, latch circuit 76 will be set and will remain in that state until one of the other fixed contacts 34 and 36 goes to the H level potential. The effects of switch bounce are therefore eliminated in a simple and effective manner by the circuit 70 in conjunction with the correction switch of the present invention.

The waveforms of the signals appearing on fixed contacts 32, 34 and 36 in response to rotation of the movable contacts 29 and 30 are shown in the waveform diagrams of FIG. 5, designated as a, b and c. The corresponding output signals A, B and C from switch bounce prevention circuit 70 are designated as d, e and f respectively.

Reference numeral 81 denotes a correction mode switch, which is coupled to the crown 16 of the timepiece such as to be opened when crown 16 is in the normal inward position (18 in FIG. 1) and is closed when crown 16 is pulled to its outward position (20 in FIG. 1). Thus, when crown 16 is in position 20, an H level potential output is produced from correction mode switch 81, while when crown 16 is in position 18, an L level potential output is produced from switch 81. This signal from mode correction switch 81 is applied to one input of an AND gate 84, which receives signal A at its other input, to one input of an AND gate 88, which receives signal B at its other input, and to one input of an AND gate 92, which receives signal C at its other input. Thus, when timepiece crown is set to the inward position 18, the L level potential signal produced from mode correction switch 81 inhibits signals A, B and C from being passed by AND gates 84, 88 and 92 respectively, while when crown 16 is set to its outward position 20, the H level potential signal produced from mode correction switch enables signals A, B and C to be transferred by AND gates 84, 88 and 92.

Reference numerals 94, 96 and 98 denote three pulse forming circuits, coupled to receive the output signals from AND gates 84, 88 and 92 respectively. Each of these pulse forming circuits has an identical configuration to that shown for circuit 94. This is composed of first and second data type flip-flops 100 and 102, and a NOR gate 104. The output from AND gate 84 is applied to the data terminal of flip-flop 100, while the 2 KHz clock signal from frequency divider circuit 56 is applied to the clock terminal of flip-flop 100. The Q output of flip-flop 100 is applied to the data terminal of flip-flop 102, while the 2 KHz clock signal, inverted by means of an inverter 106, is applied to the clock terminal of flip-flop 102. The Q (non-inverting) output of flip-flop 100 is applied to one input of NOR gate 104, while the $\overline{Q}$ (inverting) output of flip-flop 102 is applied to the other input of NOR gate 104. The output signals from pulse forming circuits 94, 96 and 98 are denoted as D, E and F respectively.

The operation of pulse forming circuit 94 is as follows. If the output signal from mode selection switch 81 is at the H potential level, then when signal A goes to the H level, an H level output is produced from AND gate 84. As a result, flip-flop 100 produces an H level output from its Q terminal following the next negative-going transition of the 2 KHz clock signal. An H level potential signal is now being applied to the data terminal of flip-flop 102, so that the Q output of flip-flop 102 goes to the H level potential upon the next negative-going transition of the 2 KHz clock signal, inverted through inverter 106. A pulse P is thereby produced from NOR gate 104, which has a pulse width equal to the time interval between the falling edge of the output from FF 100 and the rising edge of the output from FF 102, i.e. a pulse whose width is equal to one half of a period of the 2 KHz signal. Thus, each time fixed contact 32 is connected to the H level potential as the correction switch is rotated, a single pulse D is produced from pulse forming circuit 94, synchronized with the 2 KHz clock signal.

The operation of each of pulse forming circuits 96 and 98 is identical to that of circuit 92. Thus, each time fixed contact 34 is connected to the high level potential, a pulse E is produced from circuit 96, while each time fixed contact 36 is connected to the H level, a single pulse F is produced by pulse forming circuit 98.

Reference numeral 107 denotes a direction detection circuit, comprising a pulse sequence memory circuit 108 containing set/reset flip-flops (RS-FF) 109, 110 and 112, and first and second correction gate groups 114 and 116. RS-FF 109 is set by signal D from pulse forming circuit 94, and has a reset terminal coupled to receive signal F from pulse forming circuit 98. RS-FF 110 has a set terminal connected to receive signal E from pulse forming circuit 96, and a reset terminal connected to receive signal D. RS-FF 112 has a set terminal connected to receive signal F from pulse forming circuit 98, and a reset terminal connected to receive signal E. The Q (non-inverting) output terminal of RS-FF 109 produces an output signal P16 while the $\overline{Q}$ (inverting) output of RS-FF 109 produces an output signal $\overline{P16}$. The Q output of RS-FF 110 produces a signal P17, while the $\overline{Q}$ output produces a signal $\overline{P17}$. The Q output of RS-FF 112 produces a signal P18, while the $\overline{Q}$ output produces a signal $\overline{P18}$.

Reference numeral 114 denotes a first group of correction gate circuits, comprising three AND gates 118, 120 and 122, and an OR gate 124. One input of AND gate 118 is connected to receive signal E from pulse forming circuit 96, while the other input is coupled to receive signal P16. One input of AND gate 120 is connected to receive signal F from pulse forming circuit 98, while the other input is connected to receive signal P17. One input of AND gate 122 is connected to receive signal D from pulse forming circuit 94, while the other input is connected to receive signal P18. The outputs of AND gates 118, 120 and 122 are each connected to an input of OR gate 124, which produces an output signal designated as X.

Reference numeral 116 denotes a second group of correction gate circuits, comprising three AND gate circuits 126, 128 and 130. One input of AND gate 126 is connected to receive signal E from pulse forming circuit 96, and signal $\overline{P16}$. One input of AND gate 128 is connected to receive signal F from pulse forming circuit 98 at one input, and has another input coupled to receive signal $\overline{P17}$. One input of AND gate 130 is connected to receive signal D from pulse forming circuit 94 at one input, and to receive signal P18 at another input. The outputs of AND gates 126, 128 and 130 are connected to corresponding inputs of an OR gate 132, which produces an output signal designated as Y.

Output signal X from first gate circuit 114 comprises a train of pulses which is used to increment a quantity being corrected, and will therefore be referred to as an incrementing correction signal. The output signal from second gate group 116 serves to decrement a quantity which is being corrected, and therefore will be referred to as a decrementing correction signal.

The way in which correction signals X and Y are produced will now be described. It will first be assumed that RS-FF 109 is in the reset state and that RS-FFs 110 and 112 are in the set state. If now the crown 16 is rotated in the clockwise direction, then pulses D, E and F will be successively and repetitively produced by pulse forming circuits 94, 96 and 98, in that order. The first D pulse which is produced will act to set RS-FF 109, so that signal P16 goes to the H level potential. AND gate 118 is thereby enabled to pass the succeeding F signal pulse (thereby producing the second of the X signal pulses shown in FIG. 4, from OR gate 124). At the time of arrival of the D pulse which sets RS-FF 109, AND gate 122 is already enabled, so that this D signal pulse results in an X signal pulse being produced (the first of the X signal pulses shown in FIG. 4). The first E pulse to arrive acts to set RS-FF 110, so that output P17 goes to the H level potential, thereby enabling gate 120 to pass the first of the F signal pulses to arrive. As a result, another output pulse is produced from OR gate 124 (the third of the X signal pulses shown in FIG. 4). RS-FF 109, which was reset by the last-mentioned F signal pulse is then set by the next D pulse to arrive. The sequence of events described above is then repeated, so that another set of three consecutive X signal pulses are produced in response to three consecutive D, E and F pulses.

From the waveform diagram of FIG. 4, it will be apparent that at the time of arrival of an E signal pulse at AND gate 126 of second correction gate group 116, signal $\overline{P16}$ will be at the L level potential, so that no output will be produced by OR gate 132. Similarly, each time that an F signal pulse is applied to AND gate 128, this gate will be in the inhibited state, since signal $\overline{P17}$ is at the L level potential, while each time a D signal pulse is applied to AND gate 130, this gate will be in the inhibited state due to the fact that signal $\overline{P18}$ is at the L level potential. As a result, so long as the correction switch is rotated in the clockwise direction, so that the output signal pulses from pulse forming circuit 108 are produced in the order D, E F, then only a train of incrementing correction pulses X will be produced, while no decrementing correction pulses Y will be produced.

It will now be assumed that crown 16 is rotated in the counterclockwise direction, from an initial condition in which RS-FF 109 and 112 are both in the reset state and RS-FF 110 is in the reset state. Pulses will now be output from pulse shaping circuits 94, 96 and 98 in the order F, E, D, successively repeated. The first F signal pulse to be produced acts to reset FF 109, so that output P16 goes to the L level potential, thereby inhibiting AND gate 122 of the first correction gate group 114. Simultaneously, output $\overline{P16}$ goes to the H level, thereby enabling AND gate 126 of the second correction gate group 116. At the time when the first F pulse arrives, output $\overline{P17}$ is at the H level potential, so that AND gate 128 of the second correction gate group 116 is enabled to pass that first F pulse. As a result, an output pulse is produced from OR gate 132, as the first of the train of Y decrementing correction pulses shown in FIG. 4. Subsequently, when the first E pulse arrives, since AND gate 126 of the second correction gate group 116 is enabled as described above, this E pulse results in a second one of the Y pulses being produced from OR gate 132 (i.e. the second of the train of Y pulses shown in FIG. 4). This first E pulse also acts to set FF 110, so that signal $\overline{P17}$ returns to the L level potential, and also to reset FF 112, so that signal $\overline{P18}$ goes to the H level potential. AND gate 130 of the second correction gate group 116 is thereby enabled, so that the first D pulse to arrive after this is passed by AND gate 130, so that another Y decrementing correction pulse is output from OR gate 132. The is the third of the train of Y pulses shown in FIG. 4.

The above process of events is repeated for the next set of F, E, D pulses, resulting in another set of three decremental correction pulses Y being output from second correction gate group 116. It can be seen from the waveform diagrams of FIG. 4 that in this condition, i.e. counter-clockwise rotation of the crown 16, AND gate 118 is in the inhibited condition each time that an E signal pulse is applied to it, AND gate 120 is also in the inhibited state each time an F signal pulse is input to it, and similarly, AND gate 22 is in the inhibited state each time a D signal pulse is applied to it. Thus, in this condition, only decrementing signal Y is produced from second correction gate group 116, and no incrementing correction pulses X are produced from first correction gate group 114.

The incrementing correction signal X is applied to the "count up" terminals 58*c*, 60*c* and 61*c* respectively of timekeeping counter circuit 58, calendar counter circuit 60 and alarm memory circuit 61. The decrementing correction signal Y is applied to "count down" terminals 58*b*, 60*b* and 61*b* of the timekeeping counter circuit 58, calendar counter circuit 60 and alarm memory circuit 61 respectively.

The general method of operation of the timepiece circuit of FIG. 4 will now be described. In the normal timekeeping mode of operation, signal TK is continuously output from function selection circuit 68. As a result, current time information is transferred through display switching circuit 62 to display device 62, to be thereby displayed. At the same time, the timekeeping counter circuit 58 is held in a state in which its contents can be corrected by means of signals applied to "count up" terminal 58*c* or to "count down" terminal 58*b*, by the action of signal TK upon control terminal 58*a*. In the normal timekeeping mode of operation, also, the crown 16 is set to its inward position, so that correction mode switch is in the open condition, so that no generation of correction pulses can result from rotation of crown 16. If the user wishes to correct the current time information such as to increment this information, then crown 16 is first pulled to its outer position, thereby closing the correction mode switch 81 and so enabling AND gates 84, 88 and 92. Rotation of crown 16 in the clockwise direction will now result in a train of incrementing correction pulses X being produced and applied to terminal 58*c* of timekeeping counter circuit 58, thereby incrementing the current time information. The rate at which this correction is performed can be very accurately regulated by the user, in accordance with the rate at which the timepiece crown 16 is rotated. Similarly, if it is desired to decrement the current time information, this is done by rotating crown 16 in the counterclockwise direction, thereby applying a train of decrementing correction pulses Y to terminal 58*b* of timekeeping counter circuit 58. When the necessary degree of correction has been achieved, crown 16 is returned to its inward position, thereby opening correction mode switch 81 and restoring the normal timekeeping mode.

If it is now desired to correct the calendar information contained in calendar counter circuit 60, function selection pushbutton 14 is depressed once, thereby causing the CA output of function selection circuit 68 to go the the H level potential and output TK to go to the L level. In this condition, correction of calendar counter circuit 60 is enabled by the CA signal applied to its control terminal 60*a*, while signal CA also causes the calendar information to be transferred by display switching circuit 62 to be shown on display 64. The calendar information can now be either incremented, by pulling the crown 16 to its outward position and rotating crown 16 in the clockwise direction to thereby apply correction signal X to terminal 60*c* of the calendar counter circuit, or can be decremented by rotating crown 16 in the counterclockwise direction thereby applying correction signal Y to terminal 60*b* of calendar counter circuit 60. Upon completion of correcting the calendar information, crown 16 is returned to its inward position, thereby opening correction mode switch 81.

If it is now desired to set the alarm time information contained in alarm time memory circuit 61 to a new value, function selection pushbutton 14 is depressed once more, thereby causing the AL output of function selection circuit 68 to go to the H level potential and output CA to go to the L level. In this condition, correction of the contents of alarm memory circuit 61 is enabled by the AL signal applied to terminal 61*a*, while signal AL also causes the alarm time information to be transferred by display switching circuit 62 to be displayed on display 64. The alarm time information can now be either incremented, by pulling crown 16 out to its outward position and rotating it in the clockwise direction, to thereby apply correction signal X to terminal 61*c* of the alarm time memory circuit 61, or can be decremented by rotating crown 16 in the counterclockwise direction thereby applying correction signal Y to terminal 61*b* of calendar counter circuit 61. Upon completion of setting the alarm time information, crown 16 is returned to the inward position, thereby opening correction mode switch 81.

It will be appreciated that, if the mechanical arrangement shown in FIG. 3 is utilized, whereby a disengagable clutch gear 40 is moved by inward or outward displacement of the crown 16, then it is not absolutely necessary to use the crrection mode switch 81 and AND gates 84, 88 and 92 in FIG. 4. Conversely, it is possible to leave crown 16 in permanent rotatable engagement with the correction switch mechanism, omitting the clutch gear 40, if the circuit of the timepiece includes correction mode switch 81 and AND gates 84, 88 and 92.

It will be further appreciated that, although the described embodiment of the present invention contains a correction switch having three fixed contacts and two movable contacts, it is equally possible to have a greater number of fixed and movable contacts, for example four fixed contacts and three movable contacts, five fixed contacts and four movable contacts, or five fixed contacts and three movable contacts. As the number of fixed and movable contacts is increased, the number of correction pulses which can be generated for each rotation of the correction switch is increased accordingly. The fundamental conditions for the fixed and moving contacts of a correction switch for a correction signal generating system according to the present invention are that the number of movable contacts is at least two, that the number of fixed contacts is greater than the number of movable contacts, and that the number of fixed contacts and the number of movable contacts must not have a common divisor.

Another fundamentally important feature of the present invention is the switch bounce prevention circuit 70, coupled to the fixed contacts of the correction switch. When a correction switch of a correction signal generating system according to the prior art is rotated very rapidly, in order to rapidly advance a quantity which is being corrected, the problem of providing circuit means to eliminate the effects of spurious pulses resulting from stich bounce becomes rather severe. If latches or other flip-flop circuits are used for this purpose, with a conventional arrangement of correction switch having only one or two fixed contacts, then it may be difficult to arrange that setting and resetting of these circuit elements is performed with sufficient speed to provide effective anti-bounce prevention. However, this problem is eliminated by utilizing a switch bounce prevention circuit such as that of FIG. 4, numeral 70, coupled to a plurality of correction switch fixed contacts. In such an arrangement it can be seen that, for example, once a movable contact has touched fixed contact 32, thereby setting latch circuit 76, there is an appreciable time interval (i.e. the during which fixed contacts 34 and 36 are successively contacted by moving contacts) during which latch circuit 76 can be reset, before it is again set. It can be seen that even if the number of fixed contacts is appreciably increased, to five or more, thereby substantially increasing the number of correction pulses generated for each rotation of the crown 16, the time interval referred to above, during which a latch circuit such as 76 can be reset, will not be altered. Thus, with the present invention, even a very simple latch circuit arrangement such as that of FIG. 4 will provide effective switch bounce prevention, even when a large number of correction pulses are generated during each rotation of the timepiece crown.

Another fundamentally important feature of the present invention is the direction detection circuit 107, comprising pulse sequence memory circuit 108 and first and second correction gate groups 114 and 116. It should be noted that it would be possible to omit pulse forming circuits 94, 96 and 98, and to apply the outputs from switch bounce prevention circuit 70 directly to the inputs of direction detection circuit 107, and that the use of such pulse forming circuits is a matter of design preference. The pulse sequence memory circuit 108 serves to provide a combination of outputs, whose instantaneous logic states serve to indicate the current direction of rotation of the correction switch, and thereby to determine whether correction signal pulses shall be generated as output X (from first correction gate group 114) or as output Y (from second correction gate group 116). For example if the crown 16 is being rotated in the clockwise direction, then in the present embodiment it is assumed that pulses will be output from pulse forming circuits 94, 96 and 98 in the order D, E, F. Thus, if flip-flop 109 of pulse sequence memory circuit 108 is set by a pulse D, then in this case the output P16 from FF 109 will remain at the H level potential during the succeeding E pulse, and will not return to the L level until the succeeding F pulse, which resets FF 109. As a result, the F pulse referred to above will be passed through AND gate 118 of first correction gate group 114, to appear as an X correction pulse. Conversely, if crown 16 is rotated in the counterclockwise direction, then it is assumed that pulses will be output from pulse forming circuits 84 to 98 in the order D, F, E. Thus, if flip-flop 109 of pulse memory circuit 108 is set by a D pulse in this case, it will be reset by the next succeeding F pulse. Thus, output P16 will be at the L level potential during the next succeeding E pulse, so that no X correction pulse can result from the latter E pulse. On the other hand, output $\overline{P16}$ from FF 109 will be at the H level during the E pulse referred to above, so that a Y correction pulse will be produced in response to that E pulse, through AND gate 126 of second correction gate group 116.

In other words, the decision as to whether a correction pulse will be output from first gate group 114 or second correction gate group 116 is made in accordance with the current state of the logic outputs from the pulse sequence memory circuit 108 at the time of arrival of a D, E or F pulse. That logic output state, in turn, is determined by the other in which the D, E and F pulses are being input to the pulse sequence memory circuit 108.

It will be apparent that it would be possible to modify pulse sequence memory circuit 108 in such a way as to provide a two-level signal, designating either a "count up" or "count down" status of counter circuits 58, 60 and 61. In such a case, a single correction pulse output would be provided, for example by an OR gate coupled to receive the D, E and F pulses. Such a modification would come under the scope claimed for the present invention, since it would be necessary to use such an arrangement in the case of counter circuits such as 58, 60 and 61 which have a single control terminal for designating the "count up" or "count down" state and another input terminal for receiving the correction pulses, rather than the counter circuits 58, 60 and 61 of the preferred embodiment of the present invention, in which a single "count up" input terminal and a single "count down" terminal are provided, each coupled to receive a train of correction pulses.

Although various other systems have been proposed in the prior art for providing correction pulses in an electronic timepiece by switch means coupled to a rotatable crown, such prior art systems differ from the present invention with respect to the fundamental features discussed in the preceding paragraphs. In such prior art systems, a correction switch having only one or two fixed contacts is used. Thus, the maximum number of output pulses which can be produced by such a switch is limited by the characteristics of the necessary circuit arrangement for eliminating switch bounce (sometimes referred to as "chatter"), since the time interval between successive output pulses from any one fixed contact will become extremely short if the switch shaft is rotated rapidly. For such reasons, the maximum rate of production of pulses by a correction switch in such a prior art system is generally made rather low. In order to provide correction pulses at a sufficient rate to perform rapid correction of time information, therefore, means are provided in some prior art inventions whereby the time intervals between successive output pulses from the correction switch are monitored, and correction pulses are produced at a rate which is determined by the durations of such time intervals. In such an arrangement, the rate of generation of correction pulses is not linearly proportional to the speed of rotation of the timepiece crown (as is the case with the present invention) but changes abruptly at one or more different predetermined rates of rotation of the crown. Such a system provides a rather unnatural and awkward impression for the user when being employed at first, as it does not provide a feeling of smooth and gradual control of the correction process. With a correction signal generating system according to the present invention, on the other hand, the rate of generation of correction pulses varies in a smooth and proportionate manner with the rate of rotation of the crown by the user. Such a system is preferable in particular for a user who is accustomed to a timepiece having a conventional mechanical arrangement for correcting time information by roatation of a crown.

Although the present invention has been described with respect to an electronic timepiece having a digital display of information, it is equally applicable to a timepiece having an analog display of time information by time indicating hands.

From the preceding description, it will be apparent that the objectives set forth for the present invention are effectively attained. Since various changes and modifications to the above construction may be made without departing from the spirit and scope of the present invention, it is intended that all matter contained in the above description or shown in the accompanying drawings shall be interpreted as illustrative, and not in a limiting sense. The appended claims are intended to cover all of the generic and specific features of the invention described herein.

What is claimed is:

1. A correction signal generating system for an electronic timepiece having a rotatable crown, comprising;

a correction switch having a switch rotor comprising a plurality of movable contacts fixedly attached to said switch rotor concentrically about the axis of rotation thereof, disposed at equidistant angular spacings from one another such as to be rotated by said switch rotor within a common plane of rotation which is normal to said axis of rotation of the switch rotor, said correction switch further comprising a plurality of fixed contacts disposed concentrically about said axis of rotation of the switch rotor at equidistant angular distances from one another within a common plane which is normal to said axis of rotation, said fixed contacts being positioned to be successively contacted by said movable contacts as said switch rotor is rotated, the number of said fixed contacts and the number of said movable contacts being selected such as to have no common divisor other than one therebetween, said switch rotor being coupled to said crown to be rotated thereby;

an electrical power source connected to said switch for generating a switching signal from each of said fixed contacts in response to contact therewith by one of said movable contacts;

a switch bounce prevention circuit comprising a plurality of latch circuits, with each of said latch circuits being coupled to a corresponding one of said fixed contacts such as to be placed in a set condition and to thereby produce an output signal, in response to one of said switching signals appearing on said corresponding one of the fixed contacts, each of said latch circuits being further coupled to all of said fixed contacts other than said corresponding one of the fixed contacts such as to be place in a reset condition, thereby inhibiting generation of said output signal, in response to a switching signal appearing on any of said fixed contacts other than said corresponding one of the fixed contacts; and a direction detection circuit coupled to receive said output signals from said switch bounce prevention circuit, and responsive to generation of said output signals in a first predetermined sequence due to said crown being rotated in a first direction of rotation for producing a first correction signal, said first correction signal being operative to advance time information which is displayed by said electronic timepiece, and further responsive to generation of said output signals from the switch bounce prevention circuit in a second predetermined sequence, due to said crown being rotated in a second direction of rotation, for generating a second correction signal, said second correction signal being operative to retard said time information displayed by said electronic timepiece.

2. A correction signal generating system according to claim 1, in which said direction detection circuit comprises a pulse sequence memory circuit arranged to temporarily memorize each of said output signals produced from said switch bounce prevention circuit, whereby a combination of logic level output signals from said pulse sequence memory circuit vary in a first predetermined sequence in response to said first predetermined sequence of said output signals from the switch bounce prevention circuit and vary in a second predetermined sequence in response to said second predetermined sequence of the output signals from said switch bounce prevention circuit.

3. A correction signal generating system according to claim 2, in which said direction detection circuit further comprises first correction gate circuit means coupled to receive said output signals from said switch bounce prevention circuit and to receive a first combination of output signals from said pulse sequence memory circuit, whereby said output signals from said switch bounce prevention circuit are successively transferred through said first correction gate circuit means to be output as a serial pulse train comprising said first correction signal when said output signals from the switch bounce prevention circuit are generated in said first predetermined sequence, and wherein said direction detection circuit further comprises second correction gate circuit means coupled to receive the output signals from said switch bounce prevention circuit and to receive a second combination of said output signals from said pulse sequence memory circuit, whereby said output signals from the switch bounce prevention circuit are successively transferred through said second correction gate circuit means to be output as a serial pulse train constituting said second correction signal, when said output signals from the switch bounce prevention circuit are generated in said second predetermined sequence thereof.

4. A correction signal generating system according to claim 3, wherein said pulse sequence memory circuit comprises a plurality of latch circuits, each being responsive to a predetermined one of said output signals from the switch bounce prevention circuit for being placed in a set condition in which an output signal is generated therefrom, and responsive to another predetermined one of said output signals from said switch bounce prevention circuit for being placed in a reset condition in which said output signal therefrom is terminated, said switch bounce prevention being coupled to said pulse sequence memory circuit such that generation of each of said output signals from said switch bounce prevention circuit simultaneously sets one of said latch circuits of the pulse sequence memory circuit and resets another one of said latch circuits.

5. A correction signal generating system according to claim 4, wherein each of said latch circuits of the pulse sequence memory circuit has a non-inverting output and an inverting output, and in which said first correction gate circuit means comprises a first group of gate circuits each coupled to receive a corresponding one of said output signals from the switch bounce prevention circuit and a corresponding one of said non-inverting outputs of said latch circuits of the pulse sequence memory circuit, and further comprises circuit means for combining the output signals from said first set of gate circuits to thereby generate said first correction signal, and further wherein said second correction gate circuit means comprise a second group of gate circuits each coupled to receive a corresponding one of said switch signals from the switch bounce prevention circuit and a corresponding one of said inverting outputs of said latch circuits of the pulse sequence memory circuit, and further comprise circuit means for combining the output signals from said second group of gate circuits to thereby generate said second correction signal.

6. A correction signal generating system according to claim 1, in which said switch bounce prevention circuit comprises a set of latch circuits and a set of gate circuits, with each of said fixed contacts of the correction switch being coupled to a set control terminal of a corresponding one of said latch circuits, and with the remainder of said fixed contacts being coupled to inputs of one of said gate circuits, whose output is coupled to a reset control terminal of said corresponding one of the latch circuits.

7. An electronic timepiece comprising:

a source of a standard frequency timebase signal; frequency divider circuit means for frequency dividing said standard frequency timebase signal to produce a unit time signal and a clock signal;

a timekeeping counter circuit comprising a bidirectional counter circuit having a first input terminal coupled to receive said unit time signal for computing current time information, and having second and third input terminals responsive to input pulses applied thereto for incrementing and for decrementing said current time information respectively, and further having a control terminal responsive to a control signal applied thereto for selectively enabling and inbibiting said incrementing and decrementing of said current time information;

an alarm memory circuit comprising a bidirectional counter circuit having a first input terminal responsive to input pulses applied thereto for incrementing alarm time information stored therein and having a second input terminal responsive to pulses applied thereto for decrementing said alarm time information, and further having a control terminal responsive to a control signal applied thereto for selectively enabling and inhibiting said incrementing and decrementing of said alarm time information;

an externally actuatable function selection switch responsive to actuation for producing switching signals;

a function selection circuit responsive to successive initiations of said switching signals from said function selection switch for selectively producing first and second function selection signals; said first function selection signal being applied to said control terminal of the timekeeping counter circuit for enabling said incrementing and decrementing of said current time information and said second function selection signal being applied to said control terminal of the alarm memory circuit for enabling incrementing and decrementing of said alarm time information;

a display switching circuit responsive to said first function selection signal for transferring said current time information to be displayed by said electro-optical display means, and responsive to said second function display signal for transferring said alarm time information to be displayed by said electro-optical display means;

a rotatable crown movable along the axis of rotation thereof to a first position and to a second position;

a correction switch having three fixed contacts and a rotor provided with two movable contacts fixedly attached thereto, said movable contacts being arranged at predetermined angular spacings with respect to an axis of rotation of said rotor, and said fixed contacts being spaced predetermined degrees apart with respect to said axis, said rotor being coupled to said rotatable crown to be rotated thereby;

a switch bounce prevention circuit comprising a first latch circuit having a set control terminal coupled to a first one of said fixed contacts and a first gate circuit having an output coupled to a reset control terminal of said first latch circuit and input terminals coupled to second and third ones of said fixed contacts, a second latch circuit having a set control terminal coupled to said second fixed contact and a second gate circuit having an output coupled to a reset control terminal of said second latch circuit and input terminals coupled to said first and third fixed contacts, and a third latch circuit having a set control terminal coupled to said third fixed contact and a gate circuit having an output coupled to a reset control terminal of said third latch circuit and input terminals coupled to said first and second fixed contacts;

a correction mode switch coupled to said crown for producing a first control signal when said crown is in said first position and a second control signal when said crown is in said second position;

first, second and third control gate circuits coupled to receive output signals from said first, second and third latch circuits of said switch bounce prevention circuit, and responsive to said first and second control signals from said correction mode switch for selectivey enabling and inhibiting transfer of said latch circuit output signals to output terminals of said first, second and third control gate circuits respectively;

first, second and third pulse forming circuits coupled to receive output signals from said first, second and third control gate circuits respectively, each of said pulse forming circuits comprising a first data-type flip-flop having a data terminal coupled to receive the output of a corresponding one of said control gate circuits, and a clock terminal coupled to receive said clock signal, a second data-type flip-flop having a data terminal coupled to receive a non-inverting ouptut of said first data flip-flop and a clock terminal coupled to receive said clock signal in inverted form, and a gate circuit for combining the inverting output of said first gate circuit with the non-inverting output of said second gate circuit;

a pulse sequence memory circuit comprising first, second and third latch circuits, said first latch circuit having a set control terminal coupled to an output of said first pulse forming circuit and a reset control terminal coupled to receive an output of said third pulse forming circuit, said second latch circuit having a set control terminal coupled to an output of said second pulse forming circuit and a reset control terminal coupled to an output of said first pulse forming circuit, and said third latch circuit having a set control terminal coupled to an output of said third pulse forming circuit and a reset control terminal coupled to an output of said second pulse forming circuit;

a first correction gate group comprising first, second and third gate circuits, with first input terminals of said first, second and third gate circuits being coupled to outputs of said second, third and first pulse forming circuits respectively and with second input terminals of said first, second and third gate circuits being coupled to non-inverting outputs of said first, second and third latch circuits of said pulse sequence memory circuit respectively, and further comprising a fourth gate circuit for combining outputs from said first, second and third gate circuits of the first correction gate group, for thereby providing a first correction signal;

a second correction gate group comprising first, second and third gate circuits, with first input terminals of said first, second and third gate circuits being coupled to outputs of said second, third and first pulse forming circuits respectively, and with second input terminals of said first, second and third gate circuits being coupled to inverting outputs of said first, second and third latch circuits respectively of said pulse sequence memory circuit, and further comprising a fourth gate circuit for combining the outputs from said first, second and third gate circuits of the second correction gate group, for thereby providing a second correction signal;

said first correction signal being applied to said second input terminal of said timekeeping counter circuit for thereby incrementing said time information and to said first input terminal of said alarm time memory circuit for thereby incrementing said alarm time information, and said second correction signal being applied to said third input terminal of said timekeeping counter circuit for thereby decrementing said current time information and to said second input terminal of said alarm time memory circuit, for thereby decrementing said alarm time information.

* * * * *